United States Patent [19]

Desmond

[11] 4,256,237

[45] Mar. 17, 1981

[54] PLASTIC DISPENSER FOR LABELS

[76] Inventor: John W. Desmond, 104 Walter Dr., Media, Pa. 19063

[21] Appl. No.: 77,659

[22] Filed: Sep. 21, 1979

[51] Int. Cl.[3] ..... B65H 3/06; B65H 3/58

[52] U.S. Cl. ..... 221/26; 221/231; 271/22; 312/61

[58] Field of Search ..... 221/26, 231, 259, 266, 221/277, 279; 312/50, 59, 60, 61; 206/39, 39.4; 16/18 R, 31 R, 40; 271/21, 22, 23

[56] References Cited

U.S. PATENT DOCUMENTS

| | | | |
|---|---|---|---|
| 847,688 | 3/1907 | Plummer | 221/259 X |
| 1,836,246 | 12/1931 | Herold | 16/18 R X |
| 3,286,823 | 11/1966 | Gillespie | 312/61 X |
| 3,370,747 | 2/1968 | Desmond | 221/26 |
| 3,604,562 | 9/1971 | Loeffler | 221/279 X |
| 4,142,863 | 3/1979 | Covington et al. | 221/279 X |

*Primary Examiner*—F. J. Bartuska

*Attorney, Agent, or Firm*—Woodcock, Washburn, Kurtz, Mackiewicz & Norris

[57] ABSTRACT

A device for dispensing address labels from a stack contained within a receptacle wherein the receptacle comprises two complementary plastic wall sections joined together by an integral flexible hinge along one side of the receptacle with interlocking structure at the opposite side of the receptacle to hold the sections in closed position and the sections having aligned projections within the receptacle to provide an axle for a friction roller for dispensing the individual labels.

6 Claims, 3 Drawing Figures

PLASTIC DISPENSER FOR LABELS

BACKGROUND OF THE INVENTION

This invention relates to a return address label dispenser and is an improvement on the dispenser shown in my U.S. Pat. No. 3,370,747. The dispenser illustrated in my patent embodied a separate top which supported the friction roller and operating knobs and the top was removable to permit loading the dispenser with address labels. This construction was expensive to manufacture, somewhat difficult to assemble and required a separate carton for each dispenser for shipping. In an attempt to overcome these disadvantages, I designed a lightweight cardboard dispenser having a folding bottom for loading the dispenser with a stack of labels and the friction wheel was supported at the top of the dispenser by means of a rivet. The spring for forcing the stack up against the friction wheel was replaced by a compressible foam plastic which was accessible through an opening in the folding bottom. The cardboard dispenser had the disadvantage that it would not stand upright due to the folding bottom and the cardboard dispenser was subject to crushing during shipment particularly at the bottom portion below the end of the label stack.

My present invention dispenses labels by the same method disclosed in my aforesaid patent but embodies an improved simple construction which permits for ease in assembly, shipping and more economical manufacture and overcomes all the disadvantages of my prior constructions.

SUMMARY OF THE INVENTION

The present invention is directed to a label dispenser capable of allowing individual removal of successive ones of a plurality of flexible labels arranged in a stack and secured at only one edge thereof to each other by adhesive along one side of the stack, the dispenser comprising a receptacle for containing the stack a pusher for urging the stack in a direction within the receptacle such that the secured edge of the outermost label lies adjacent a first opening in the receptacle, and a friction roller within the receptacle and in contact with the outermost label for causing a force component to be applied to the outermost label for movement thereof out of the receptacle whereby the outermost label may be removed from the stack by manually tearing at its secured edge, and particularly the improvement wherein the receptacle comprises two complementary plastic wall sections joined together by an integral flexible hinge along one side of the receptacle, interlocking structure at the opposite side of the receptacle to hold the sections in closed position, and the sections having aligned projections within the receptacle adjacent the first opening thereof to provide an axle for the friction roller. In the preferred form of the invention the receptacle is molded from polypropylene and the interlocking structure on the sections of the receptacle comprises at least one mating tongue and groove having a forced fit to provide a latch for the receptacle.

DESCRIPTION OF THE PREFERRED EMBODIMENT

Figure 1:
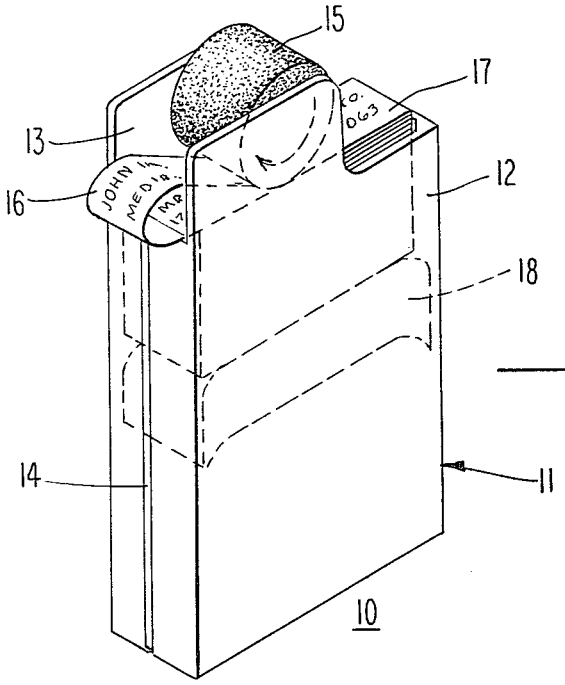
FIG. 1 is a perspective view of a preferred embodiment of my invention with the label dispenser illustrated in operating position.

Referring to FIG. 1 there is shown a return address label dispenser 10 having a receptacle 11 which comprises two complementary plastic wall sections 12 and 13 joined together by an integral flexible hinge 14 along one side of the receptacle. The upper end of the receptacle is provided with a friction roller 15 which is adapted to rotate in a clockwise direction as illustrated by the arrow in FIG. 1 for dispensing the uppermost label 16 from the stack of labels 17 disposed within the receptacle 11. The label stack 17 is urged upwardly against the friction roller 15 by means of a pusher 18 which engages the bottom of the label stack 17 and frictionally engages the inner walls of the receptacle 11.

In the preferred form of the invention the receptacle 11 is molded from polypropylene. This material is selected because of its physical characteristics of toughness and flexibility and also the fact that this plastic has a good memory, i.e. the ability to remain in the shape in which it is molded. The two complementary wall sections 12 an 13 of the receptacle 11 may be more clearly seen in FIG. 2 where the receptacle is illustrated in open position. In manufacturing the receptacle 11 the two halves or sections 12 and 13 are molded simultaneously and joined at the hinge 14. The hinge 14 is a relatively thin section of polypropylene as compared to the other wall thicknesses of the receptacle and the flexibility of the plastic material makes possible the use of the integral hinge 14 which is sometimes referred to as a "living" hinge.

Figure 2:
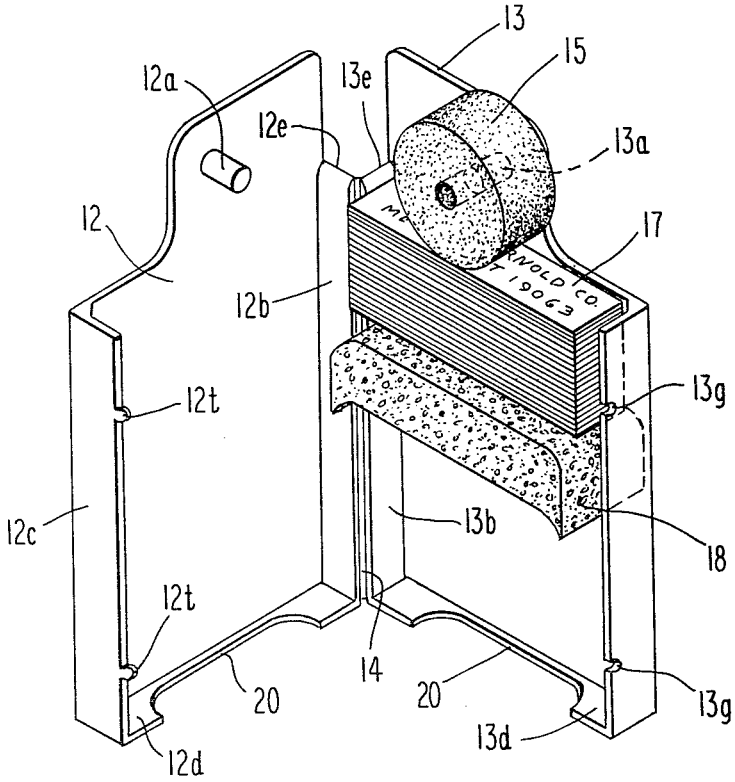
FIG. 2 is a perspective view of the dispenser shown in FIG. 1 but in open position for loading.

As may be seen in FIG. 2 each of the receptacle sections 12 and 13 has molded integral therewith a projection 12*a* and 13*a*. When the receptacle 11 is in closed position these projections 12*a* and 13*a* are aligned within the receptacle adjacent the opening at the top of the receptacle and provide an axle for the friction roller 15. Th half sections 12 and 13 each include perpendicularly extending side walls 12*b* and 12*c* and 13*b* and 13*c* respectively and bottom walls 12*d* and 13*d*. The side walls 12*b* and 13*b* are joined at the flexible hinge 14. The side wall 12*c* of section 12 is provided with a pair of tongues 12*t* which are adapted to be received by the mating grooves 13*g* in the side wall 13*c* of section 13. The mating tongue and groove members 12*t* and 13*g* are so dimensioned (the tongue is wider than the opening of the groove) as to permit the tongue members 12*t* to snap into place into the grooves 13*g* with a forced fit to provide a latch and thereby hold the two retainer sections 12 and 13 in closed position in cooperation with the hinge 14. The axle portions 12*a* and 13*a* for the friction roller 15 are so positioned at the upper end of the receptacle 11 that the bottom of the friction roller 15 is slightly above the upper edge 12*e* and 13*e* of the retainer sections 12 and 13. Thus when the stack of labels 17 is inserted in the receptacle 11 with the adhesive side of the stack adjacent the side walls 12*b* and 13*b*, and the pusher member 18 is in place against the bottom of the stack, the uppermost label will be in a position to be dispensed by rotation of the friction roller 15 as shown in FIG. 1. To further facilitate tearing the labels from adhesive attachment to the stack, the wall sections 12*b* and 13*b* are bevelled to a thin edge at 12*e* and 13*e* respectively. This may be seen in FIG. 2.

The friction roller 15 may be made fom any suitable material however it is preferably made from neoprene, a synthetic rubber. This material has the desirable physical characteristics of being relatively firm and having a high coefficient of friction. Upon rotating the friction roller 15 as illustrated in FIG. 1, the friction of the roller will cause the uppermost label to bow outwardly and move out from under the roller 15 thus permitting removal of the label by tearing at the adhesive edge which extends along one side of the stack.

Figure 3:
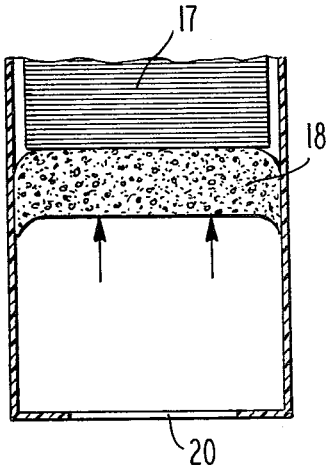
FIG. 3 is a partial sectional view illustrating the application of force to the bottom of the label stack.

The presser member or pusher 18 preferably is made of virgin polyurethane foam having a density of 3 lb./cu. ft. and an indentation load deflection (ILD) of 60. The foam is formed in a large slab then converted into ½" thick sheets which are die cut into rectangular solids to fit the retainer as shown in the drawings. The virgin polyurethane material has high energy absorption, flexibility and high coefficient of friction properties. These properties permit the polyurethane foam to compress when pushed up against the bottom of the stack thus acting as a spring for label dispensing. The high coefficient of friction enables the pusher 18 to anchor itself to the inner side walls of the receptacle while the pusher is compressed for the spring like action. As may be seen in FIGS. 2 and 3 the receptacle 11 has a flat bottom formed by walls 12*d* and 13*d* which are integral with the plastic wall sections 12 and 13 respectively. The bottom has an opening 20 having an area less than the area of the labels to provide access to the pusher 18 for adjustment of the biasing pressure on the stack 17 against the friction roller 15 within the receptacle. This is illustrated in FIG. 3 by the arrows.

From the foregoing description and the drawing it will be seen that my new dispenser 10 embodies an improved and simple construction which overcomes the disadvantages of my prior designs. The receptacle 11 is of one piece construction with two complementary plastic wall sections 12, 13 joined together by an integral flexible hinge 14 along one side of the receptacle and integral interlocking structure 12*t*, 13*g* at the opposite side of the receptacle to hold the sections in closed position. The sections 12, 13 have aligned projections 12*a*, 13*a* integral therewith and disposed within the receptacle to provide an axle for the friction roller 15 which dispenses the labels from the stack. The dispenser 10 is loaded by opening the receptacle 11 in the manner illustrated in FIG. 2, inserting a stack of labels 17 beneath the friction roller 15 and positioning the pusher 18 against the bottom of the label stack. When the receptacle is closed as shown in FIG. 1 the friction roller 15, the stack 17 and the pusher 18 are all securely retained within the receptacle 11. The pusher 18 may be moved upwardly and compressed against the bottom of the stack in the closed receptacle by applying pressure thereto as illustrated by the arrows in FIG. 3. This may be accomplished by inserting a pencil or any other similar device through the opening 20 in the bottom of the receptacle.

By molding the receptacle from polypropylene or equivalent plastic having similar physical properties, it is not only possible to utilize my one piece construction for the receptacle but the receptacle will have sufficient strength to permit shipping the dispenser without special packaging and thereby futher reducing the total cost. The density of the plastic may be controlled so that the dispenser is slightly translucent to permit a reading of the fullness of the dispenser. The receptacle also may be molded with an anti-slip outer surface on sections 12 and 13 for convenience in handling the dispenser.

While the invention has been particularly shown and described with reference to the preferred embodiment thereof, it will be understood by those skilled in the art that various changes in form and detail and in applying the concepts of the invention may be made without departing from the spirit or scope thereof.

What is claimed is:

1. In a label dispenser capable of allowing individual removal of successive ones of a plurality of flexible labels arranged in a stack and secured at only one edge thereof to each other by adhesive along one side of the stack, the dispenser comprising a receptacle for containing the stack, a pusher for urging the stack in a direction within the receptacle such that the secured edge of the outermost label lies adjacent a first opening in the receptacle, and a friction roller within the receptacle for contact with the outermost label for causing a force component to be applied to the outermost label for movement thereof out of the receptacle whereby the outermost label may be removed from the stack by manually tearing at its secured edge, the improvement wherein said receptacle comprises two complementary plastic wall sections joined together by an integral flexible hinge along one side of said receptacle, interlocking structure at the opposite side of said receptacle to hold said sections in closed position, and said sections supporting structure comprising aligned projections integral with said sections within said receptacle adjacent said first opening thereof to provide an axle for the friction roller.

2. In a label dispenser according to claim 1 wherein said receptacle is molded from polypropylene.

3. In a label dispenser according to claim 1 wherein said receptacle has a flat bottom integral with said plastic wall sections, said receptacle having a second opening in said bottom thereof, said second opening having an area less than the area of the labels to provide access to the pusher for adjustment of the biasing pressure on the stack against the friction roller within said receptacle.

4. In a label dispenser according to claim 1 wherein said interlocking structure comprises on said sections at least one mating tongue and groove having a forced fit.

5. In a label dispenser capable of allowing individual removal of successive ones of a plurality of flexible labels arranged in a stack and secured at only one edge thereof to each other by adhesive along one side of the stack, the dispenser comprising a receptacle for containing the stack, a pusher for urging the stack in a direction within the receptacle such that the secured edge of the outermost label lies adjacent a first opening in the receptacle, and a friction roller within the receptacle for contact with the outermost label for causing a force component to be applied to the outermost label for movement thereof out of the receptacle whereby the outermost label may be removed from the stack by manually tearing at its secured edge, the improvement wherein said receptacle is of one piece molded plastic construction and comprises two complementary plastic wall sections joined together by an integral flexible hinge extending along substantially the length of one side of said receptacle, said hinge being of relatively thin section of flexible plastic as compared to the other wall thicknesses of said receptacle to provide flexibility of said hinge, interlocking structure at the opposite side of said receptacle to hold said sections in closed position, and said sections supporting structure comprising aligned projections integral with said sections within said receptacle adjacent said first opening thereof to provide an axle for the friction roller.

6. In a label dispenser according to claim 5 wherein said receptacle is molded from polypropylene.

* * * * *